United States Patent [19]

Keys

[11] Patent Number: 4,786,054

[45] Date of Patent: Nov. 22, 1988

[54] GOLF TEE WITH ROTATABLE HEAD

[76] Inventor: Francis J. Keys, 9532 Cortada, El Monte, Calif. 91733

[21] Appl. No.: 38,946

[22] Filed: Apr. 16, 1987

[51] Int. Cl.[4] ..... A63B 57/00

[52] U.S. Cl. ..... 273/33

[58] Field of Search ..... 273/33, 201, 202, 203, 273/204, 205, 206, 207, 208, 209, 210, 211, 212

[56] References Cited

U.S. PATENT DOCUMENTS

| | | | |
|---|---|---|---|
| 2,470,817 | 5/1949 | Hendricks | 273/207 |
| 3,079,158 | 2/1963 | Finn et al. | 273/212 |
| 3,947,027 | 3/1976 | Brown | 273/33 |
| 4,418,916 | 12/1983 | Matsurra | 273/207 |
| 4,524,974 | 6/1985 | Matsurra | 273/207 |
| 4,610,451 | 9/1986 | Keys | 273/33 |

*Primary Examiner*—Richard C. Pinkham
*Assistant Examiner*—T. Brown
*Attorney, Agent, or Firm*—John T. Matlago

[57] ABSTRACT

A golf tee comprising a rotatable support member seated so as to be submerged within a hollow head portion of an elongated body with the side surface of the rotatable support member engaged by an O-ring to the internal side surface of the hollow head portion. A pointed bottom member is removably connected to the lower end of the elongated body. An elastic element extending through an axial hole in the elongated body connects the rotatable support member to the pointed bottom member. Manually rotating the rotatable support member provides for storing energy in the elongated elastic element such that when a golf ball is placed on the rotatable support member the golf ball can be made to slowly rotate about a vertical axis to thereby provide a moving object for holding the attention of a golfer as he addresses and drives the ball.

12 Claims, 2 Drawing Sheets

GOLF TEE WITH ROTATABLE HEAD

BACKGROUND OF THE INVENTION

This invention relates to devices for use in the game of golf and more particularly to a novel structure of a tee for use by a golfer to improve his game.

It has been previously disclosed in U.S. Pat. No. 4,610,451, issued Sept. 9, 1986 on an application of the present inventor, that golf differs from other games, such as baseball, because a golf ball does not move until it is hit. As a result, when a golfer addresses and drives a golf ball, he requires a greater amount of concentration and is more likely to be distracted by sounds and/or movements in his range of vision which could cause him to improperly hit the ball.

Although the golf tee constructed with a rotatable head member located on the top thereof as disclosed in the previously mentioned patent is well suited for its purpose of slowly rotating a golf ball carried on the rotatable head member to enhance the concentration of the golfer as he addresses and drives a golf ball, the golf tee of the present invention has advantages not previously disclosed. In particular, the golf tee of the present invention provides a rotatable support member for the golf ball which is submerged within the hollow head of the tee. As a result, not only is the support member more sturdily mounted and protected from possible contact with the head of the driver during the driving of the ball, but the tee is more simply constructed and less expensive to manufacture.

SUMMARY OF THE INVENTION

Briefly, the tee of the present invention comprises an elongated body having an axial hole therethrough and a hollow head portion together with a removably connected pointed bottom member having a hook on the upper end thereof. A rotatable support member provided with a hook on the lower end thereof is adapted to be submerged within the hollow head such that the only contact of the rotating support member with the internal sidewall of the hollow head is by way of a ring-like frictional means. An elongated elastic element axially extending through the axial hole in the elongated body of the tee is connected between the hook on the lower end of the rotatable support member and the hook on the upper end on the pointed bottom member Upon manually rotating the support member relative to the hollow head to store elastic energy in the elongated elastic element, a golf ball carried on the support member is controlled by the action of the ring-like frictional means to slowly rotate about the vertical axis of the tee by the untwisting of the elongated elastic element.

Accordingly, the primary object of the present invention is to provide for submergingly mounting a rotatable support member in a hollow head portion of a tee in such a manner as to provide for a golf ball being carried on the support member to slowly rotate so as to enhance the concentration of a golfer as he addresses and drives the golf ball.

Another object of the present invention is to provide for submergingly mounting a rotatable support member in a hollow head portion of a tee in such a manner that the support member carrying a golf ball can be made to slowly rotate by use of energy stored in an elongated elastic element extending through a axial hole provided in the elongated body of the tee.

Still another object of the present invention is to provide a tee with a rotatable support member that is submerged within the hollow head portion thereof so as to protect the support member from direct contact with the head of a driver when a golf ball carried thereon is being driven by a golfer.

With these and other objects in view, the invention consists of the construction, arrangement and combination of the various parts of the device whereby the objects contemplated are attained as hereinafter set forth, pointed out in the appended claims and illustrated in the accompanying drawings.

DESCRIPTION OF THE PREFERRED EMBODIMENT

Figure 1:
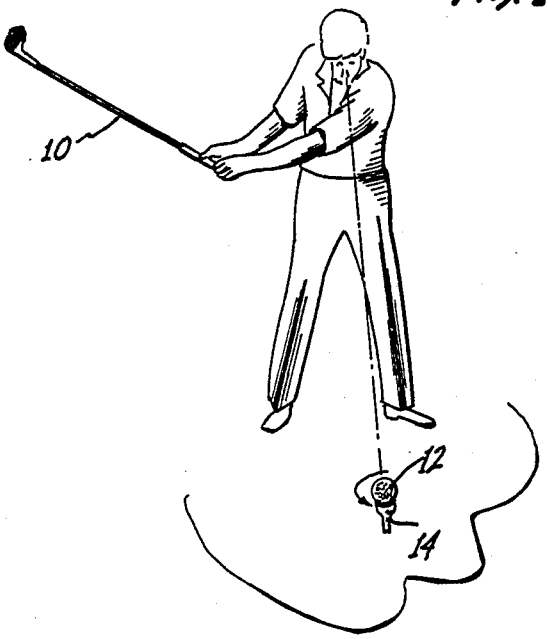
FIG. 1 shows a golfer taking a swing with his driver to drive a golf ball that is being slowly rotated about a vertical axis by the tee of the present invention.
Figure 5:
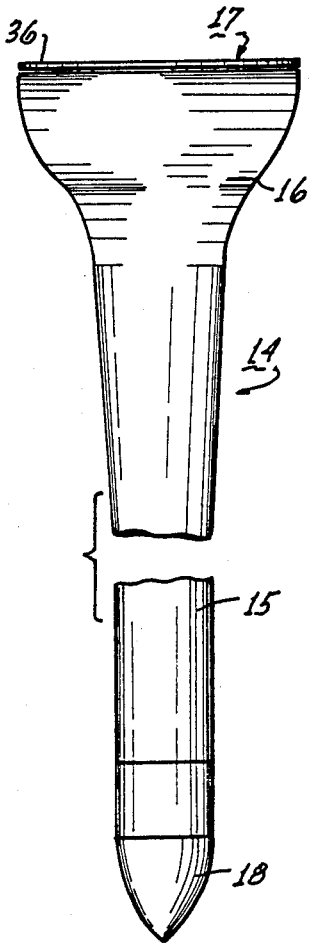
FIG. 5 is an elevation view of the tee of the invention.

Referring to FIG. 1, a golfer is shown taking a swing with a driver 10 to drive a golf ball 12 which is being carried on the top of a tee 14 constructed in accordance with the present invention. As illustrated, while the golfer has his eyes focused on the golf ball 12 during the swinging of the driver 10, the golf ball is being slowly rotated about the vertical axis of the tee 14 on the order of once every 25 to 30 seconds.

Figure 2:
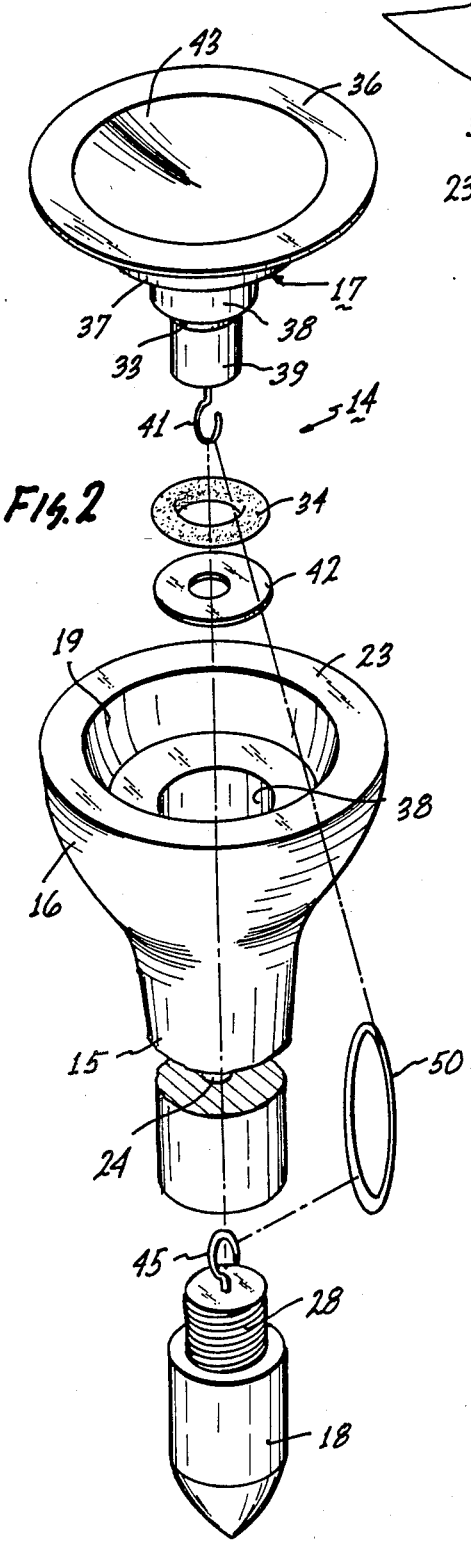
FIG. 2 is an exploded view of the component parts of the tee of the present invention.

As shown in FIG. 2, the component parts of the tee 14 include an elongated body 15 having an axial hole 24 therethrough and provided with a hollow head portion 16, a support member 17 which is to be mounted for axial rotation within the hollow head portion 16, and a removably connected pointed bottom member 18. The tee also includes a speed regulating O-ring 34, a washer 42, and a rubber band 50.

Figure 3:
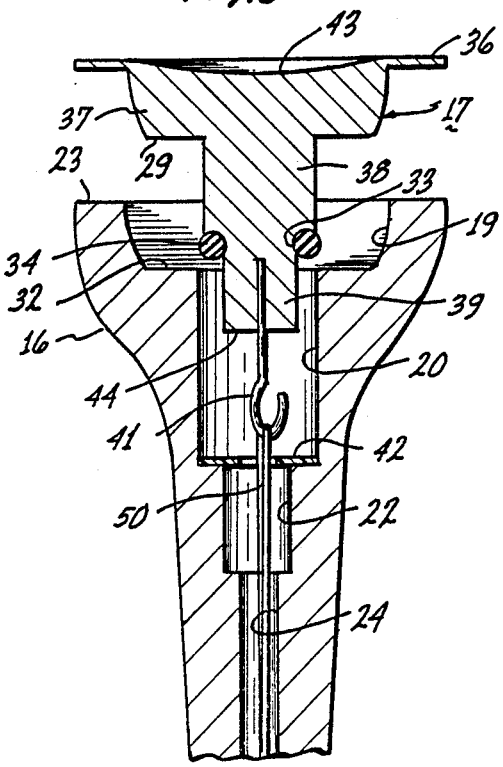
FIG. 3 is a showing of the rotatable support member being inserted within the hollow head portion of the tee.
Figure 4:
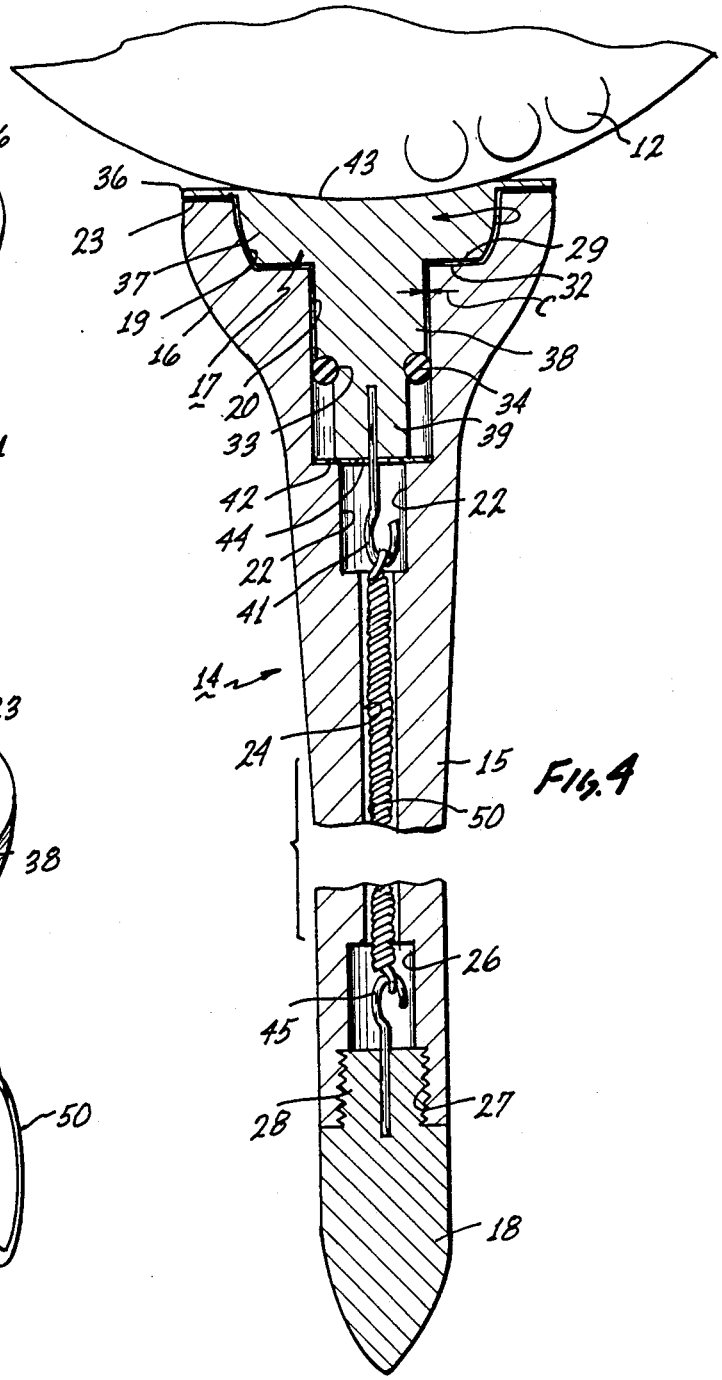
FIG. 4 is a vertical sectional view of the assembled tee showing a golf ball on the top of the support member being slowly rotated by the untwisting of a rubber band that extends through an axial hole in the elongated body of the tee and connects the lower end of the support member and the upper end of the pointed bottom member of the tee.

As best shown in FIG. 3, the hollow head portion 16 of the tee is formed to comprise an axial disk-like upper bore 19, an axial intermediate bore 20 of smaller diameter than the upper bore, and an axial lower bore 22 of smaller diameter than the intermediate bore. As best shown in FIG. 4, the axial hole 24 in the elongated body 15 extends from the bottom of the lower bore 22 in the hollow head portion 16 to the top of an axial bore 26 provided on the bottom of the elongated body 15. The lower end portion of the bottom bore 26 is provided with internal threads 27. The removably connected pointed bottom member 18 of the tee is formed with a small diameter boss 28 on the upper end thereof which is threaded to enable it to engage the internal threads 27 provided on the bottom bore 26 of the elongated body 15. A hook 45 is attached to extend up from the top of boss 28 on the pointed bottom member 18.

Referring back to FIG. 3, the support member 17 is formed to comprise a large diameter disk-like upper portion 37, a smaller diameter cylindrical intermediate portion 38 and a still smaller diameter cylindrical stem portion 39 having a flat bottom surface 44. A hook 41 is attached to extend down from the flat bottom surface 44 of the stem portion 39 of support member 17. The top of the disk-like portion 37 is formed with a concentric recessed arcuate surface 43 to carry a golf ball 12 and a peripherally extending, thin, circular flange 36 extends about the top edge of the disk-like portion 37. As will be more clearly evident hereinafter, the purpose of the thin flange 36 is to assist in removing the support member 17 from its sunken position within the hollow head portion 16 when it is necessary to gain access to the interior of the hollow head portion 16 to repair or otherwise adjust the tee.

Before the insertion of the rotatable support member 17 within the hollow head portion 16, the O-ring 34 preferably made of a resilient hard rubber material is forced over the cylindrical stem portion 39 of the rotatable support member 17 and pushed up until it seats in a groove 33 formed just below the shoulder defined by the bottom surface of the cylindrical intermediate portion 38. Thus, as noted in FIG. 3, prior to the insertion of the rotatable support member 17 within the hollow head portion 16, the outer diameter of the O-ring 34 projects a little beyond the outer surface of the cylindrical intermediate portion 38. In addition, the flat, thin washer 42 made of a material with a low coefficient of friction, such as Teflon, is inserted into the hollow head portion 16 so as to be located on the bottom of the axial intermediate bore 20.

When the support member 17 is to be assembled within the hollow head portion 16, one end of the rubber band 50 is placed over the hook 41 extending from the bottom thereof, and, by use of an elongated tool (not shown), the other end of the rubber band 50 is pulled down through the axial hole 24 so as to extend out of the bottom bore 26 and is temporarily held in this position.

As will be made clear by viewing FIGS. 3 and 4, as the support member 17 is being inserted down for assembly within the hollow head portion 16 of the tee, the outer diameter of the O-ring 34 held in the groove 33 of the cylindrical stem portion 39 just below the cylindrical intermediate portion 38 rubs slightly against the inner surface of the intermediate bore 20. The support member 17 finally becomes seated within the hollow head portion 16 when the flat surface 44 on the bottom of its stem portion 39 contacts the washer 42 located on the bottom of the intermediate bore 20. The contacting of the circular wall of the intermediate axial bore 20 by the outer diameter of O-ring 34 serves to concentrically center the support member 17 within the hollow head portion 16. These parts are so constructed that when so positioned, the disk-like upper portion 37 and the cylindrical intermediate portion 38 of support member 17 respectively reside within the disk-like bore 19 and the cylindrical bore 20 of the hollow head portion 16 with a slight clearance C of approximately 0.005 of an inch from the sidewalls thereof.

Likewise, the parts are constructed such that the resting of the bottom flat surface 44 of the stem portion 39 on the washer 42 results in the bottom of flange 36 on the disk-like upper portion 37 being positioned with a clearance C of approximately 0.005 of an inch above the upper end wall 23 of the hollow head portion 16 and with the bottom surface 29 of the disk-like upper portion 37 being positioned with a similar clearance C above the bottom surface 32 of the disk-like upper bore 19.

When the support member 17 is so assembled, the hook 41 on the bottom of its stem portion 39 extends down into the lower bore 22. Since the upper end of the rubber band 50 that is extending through the axial hole of the elongated body 15 is connected to the hook 41, the lower end of the rubber band 50 can now be connected to the hook 45 on the top of the pointed bottom member 18 and the latter then secured by engaging its threaded boss 28 on the internal threads provided on the lower portion of the bottom bore 26 of the elongated body 15. As a result, hook 45 now extends up into the bottom bore 26. This completes the assembly of the tee, as shown in FIG. 4.

It should now be clearly understood that when the rotatable support member 17 is submerged within the hollow head portion 16 of the tee, the only points of contact of the support member 17 therein are the bottom flat surface 44 of the cylindrical stem portion 39 thereof which sits on the washer 42 made of a material with a low coefficient of friction and the outer surface of the O-ring 34 which is being carried on the stem portion 39 thereof and resiliently contacts the inner wall of the intermediate bore 20.

It should now be clearly understood that since the rubber band 50, extending through the axial hole 24 in the elongated body 15 has its upper end connected to the hook 41 on the lower end of the rotatable support member 17 and its lower end connected to the hook 45 on the top of the stationary pointed bottom member 18, when it is desired to use the tee, one first holds the tee, for example, by placing the forefinger of one hand on the recessed arcuate surface 43 of the rotatable support member 17 and the thumb of the same hand on the bottom pointed member 18. The elongated body 15 of the tee can then be rotated with the fingers of the other hand until the rubber band 50 is taut. Elastic energy is thus stored in the rubber band 50. A golf ball may then be placed on the recessed arcuate surface 43 of the rotatable support member 17 and the pointed bottom member 18 of the tee pushed into the ground.

Thus, as the rubber band 50 unwinds, the support member 17 is caused to rotate on its bottom surface 44 which is contacting the low friction washer 42. Hence, it is as a result of the friction designed to be produced by the O-ring 34 bearing against the sidewall of the intermediate bore 20 that the ball 12 is made to slowly rotate about the vertical axis of the tee on the order of once every 25 to 30 seconds while the golfer is addressing and swinging his driver to drive the should now be noted that the submerging of the ball. It should now be noted that the submerging of the rotating support member 17 within the hollow head portion 16 of the tee assures that it is protected from direct impact with the head of the driver if the golfer happens to swing a little too low when he drives the golf ball being carried thereby.

It should be further noted that all or any selected ones of the component parts of the tee including the elongated body 15, the pointed bottom member 18 and/or the rotatable support member 17 can be made of wood, plastic or a metal, such as aluminum, for example, in order to provide a more durable and/or reliably operating tee.

While the preferred embodiment of the device as described herein is well adapted to fulfill the objects and advantages previously mentioned as desirable, it is to be understood that the invention is not limited to the specific features shown and described but that the means and configurations herein disclosed are susceptible of modification in form, proportion and arrangement of parts without departing from the principles involved or sacrificing any of its advantages, and the invention is, therefore, claimed in embodiments of various forms all coming within the scope of the claims which follow.

What is claimed is:

1. A golf tee comprising:

an elongated body including a hollow head portion with an axial bore providing an internal sidewall, a lower end, and an axial hole extending from the axial bore through the lower end thereof;

a pointed bottom member having an upper end removably connected to the lower end of said elongated body;

a rotatable support member having a lower end seated within said hollow head portion and having a sidewall spaced with a clearance from the internal sidewall of said hollow head portion;

annular friction means positioned to lie in the clearance space between said rotatable support member and said hollow head portion; and an elastic element extending through the axial hole of said elongated body and connecting the lower end of said rotatable support member to the upper end of said pointed bottom member;

whereby said rotatable support member can be manually rotated relative to said hollow head portion to store energy in said elastic element which can thereafter be used to rotate said rotatable support member and a golf ball carried thereon about a vertical axis.

2. A gold tee as claimed in claim 1 wherein a washer is inserted within said hollow head portion, and said rotatable support member is seated on said washer.

3. A golf tee as claimed in claim 2 wherein said washer is made of a material having a low coefficient of friction.

4. A golf tee as claimed in claim 1 wherein said friction means is a rubber O-ring.

5. A golf tee as claimed in claim 1 wherein said clearance is approximately 0.005 of an inch.

6. A golf tee as claimed in claim 1 wherein said friction means limits the rotation of said rotatable support member to approximately one revolution every 25 to 30 seconds.

7. A golf tee as claimed in claim 1 wherein said rotatable support member is provided with a peripherally extending thin flange about the upper end thereof.

8. A golf tee as claimed in claim 1 wherein internal threads are provided on the lower end of said elongated body and the upper end of said pointed bottom member is provided with a threaded boss for engaging said internal threads.

9. A golf tee as claimed in claim 1 wherein said rotatable support member is provided with a hook on the lower end thereof and said pointed bottom member is provided with a hook on the upper end thereof and said elastic element is connected between said hooks.

10. A golf tee comprising:

an elongated body including a hollow head portion, a lower end, and an axial hole extending from the hollow head portion through the lower end thereof;

a pointed bottom member having an upper end removably connected to the lower end of said elongated body, said pointed bottom member provided with a hook on the upper end thereof;

said hollow head portion formed with an upper axial bore and an intermediate axial bore having a diameter smaller than said upper bore, and a bottom shoulder;

a rotatable support member including an upper portion, a cylindrical intermediate portion of smaller diameter than said upper portion, and a cylindrical stem portion having a smaller diameter than said intermediate portion and a bottom surface, said cylindrical stem portion provided with a hook on the bottom surface thereof;

an annular resilient frictional means fitted about said cylindrical stem portion, the outer diameter of said frictional means being normally slightly larger than the diameter of said intermediate bore;

said rotatable support member being mounted within said hollow head portion with the bottom surface of said cylindrical stem portion seated adjacent the bottom shoulder of said intermediate bore, and the upper portion and cylindrical intermediate portion respectively spaced with a clearance from said axial bore and the intermediate bore of said hollow head portion, whereby only the annular resilient frictional means contacts the intermediate bore; and an elastic element extending through the axial hole of said elongated body and connecting said hook on the upper end of said pointed bottom member to said hook on the bottom surface of said cylindrical stem portion;

whereby said rotatable support member can be manually rotated relative to the hollow head portion to thereby twist said elastic element and store energy therein thereby enabling said rotatable support member and a golf ball carried thereby to be thereafter rotated relative to the hollow head portion by the untwisting of the elastic element at a rate determined by the annular resilient frictional means.

11. A golf tee as claimed in claim 10 wherein said annular resilient frictional means is a rubber O-ring.

12. A gold tee comprising:

an elongated body including a hollow head portion having an axial bore providing an internal sidewall and a bottom shoulder, a lower end, and an axial hole extending from the axial bore through the lower end thereof;

a pointed bottom member having an upper end removably connected on the lower end of said elongated body;

a rotatable support member having an axial body with a sidewall and a lower end; and resilient friction means securely encircling and slightly protruding from the sidewall of said rotatable support member;

said rotatable support member positioned within said hollow head portion with its lower end seated adjacent the bottom shoulder of said axial bore and with its sidewall spaced with a clearance from the internal sidewall of said hollow head portion such that only the resilient friction means engages the internal sidewall;

an elastic element extending through the axial hole of said elongated body; and means for connecting the elastic element between the lower end of said rotatable support member and the upper end of said pointed bottom member;

whereby said rotatable support member can be manually rotated relative to said hollow head portion to store energy in the elastic element which can thereafter by used to slowly rotate said rotatable support member and a golf ball carried thereon relative to the hollow head portion.

* * * * *